US005762399A

United States Patent [19]

Liu

[11] Patent Number: 5,762,399

[45] Date of Patent: Jun. 9, 1998

[54] INCLINATION POSITIONING DEVICE FOR ROCKING TYPE CHAIRS

[76] Inventor: Clement Liu, No. 56-3, Kan Tung Tsun, Kuei Jen Hsiang, Tainan Hsian, Taiwan

[21] Appl. No.: 748,540

[22] Filed: Nov. 13, 1996

[51] Int. Cl.[6] ..... A47C 3/28

[52] U.S. Cl. ..... 297/302.7; 297/300.8; 297/301.7

[58] Field of Search ..... 297/302.3, 302.4, 297/302.7, 300.8, 301.7

*Primary Examiner*—Peter R. Brown
*Assistant Examiner*—Stephen Vu
*Attorney, Agent, or Firm*—Morton J. Rosenberg; David I. Klein; Jun Y. Lee

[57] ABSTRACT

A positioning device includes a mounting frame mounted to an underside of a chair seat. The mounting frame includes a positioning portion having a plurality of vertically spaced engaging notches. An adjusting base is mounted to the mounting frame and yet allows relative pivotal motion therebetween. A spring-biased adjusting rod is movable between a first position where the mounting frame is rockable relative to the adjusting base and a second position where the mounting frame is not rockable relative to the adjusting base.

3 Claims, 6 Drawing Sheets

INCLINATION POSITIONING DEVICE FOR ROCKING TYPE CHAIRS

BACKGROUND OF THE INVENTION

1. Field of the Invention

The present invention relates to a positioning device which may determine an inclination angle of a rocking type chair.

2. Description of the Related Art

Chairs nowadays must provide comfort and safety in addition to esthetics. A pressure rod is often provided to a seat, chassis of the chair such that the chair seat can be adjusted in the height thereof upon adjustment of the length of the pressure rod. A typical chair seat chassis structure for a rocking type chair is illustrated in FIG. 9 of the drawings. The chair seat chassis structure includes a mounting base 1', an adjusting base 2', an axle 3', an adjusting rod 4', and a spring 5'.

The mounting base 1' includes a plurality of holes through which fastener elements (such as screws) extend so as to fix the mounting base 1' to an underside of the chair seat. A first axle hole 11' and a first slot 12' are defined in each of two lateral walls of the mounting base 1'. The adjusting base 2' includes a through hole 21' defined in a center thereof through which a pressure rod 24' extends. The adjusting base 2' further includes a second axle hole 22' and a second slot 23' defined in each of two lateral walls thereof and respectively in alignment with the first axle holes 11' and the first slots 12'. The axle 3' is extended through the first and second axle holes 11' and 22, thereby securing the adjusting base 2' to the mounting base 1'. In addition, the mounting base 1' is pivotable about the axle 3' Furthermore, the adjusting rod 4' is extended through the first and second slots 12' and 23', wherein the adjusting base 2' is retained in position when a front end 43' of the adjusting rod 4' is inserted into the associated first slot 12' (which cannot be seen from FIG. 9), i.e., the adjusting seat 2' cannot rock while an inclination angle of the seat is fixed. In addition, an operative crooked section 41' is formed on the adjusting rod 41' for pressing against the pressure rod 24' upon manual rotation of the adjusting rod 41', thereby. adjusting the height of the seat. Furthermore, a stop 42' is provided on the adjusting rod 41' for limiting a travel distance of the adjusting rod 4'.

A screw 51' is extended through a screw hole 13' defined in the mounting seat 1' and through the spring 5'. The spring 5' is thus secured to the underside of the seat by the screw 51' and a sleeve 52'. When in use, if the user would like to have a larger rearward inclination angle, the adjusting rod 4' is pulled rearwardly to allow relative movements between the adjusting seat 2' and the mounting seat 1' for adjustment thereof. In addition, when the seat is moved rearwardly, the mounting seat 1' is also moved to compress the spring 5' which allows the seat to rock due to the elasticity of the spring 5.

Nevertheless, if the user does not want to sit on a rockable chair, the adjusting rod 4' has to be used to prevent rocking motion of the chair, yet the inclination angle of the seat is also fixed, and such an inclination angle cannot fit all users. Accordingly, the user may feel uncomfortable when sitting on the chair, and after a long term use, the user may feel exhausted and have a lack of balance due to having an uncomfortable sitting gesture.

Therefore, there has been a long and unfulfilled need for an improved rockable chair which mitigates and/or obviates the above problems.

SUMMARY OF THE INVENTION

In accordance with the invention, a positioning device for a rocking type chair comprises a mounting frame mounted to an underside of a chair seat. The mounting frame includes a connecting beam at one end thereof. An extension plate extends from the connecting beam and has a positioning portion formed on a distal end thereof, the positioning portion including a plurality of vertically spaced engaging notches. An adjusting base comprises a recess for pivotally receiving the connecting beam therein. The extension plate extends through the adjusting base yet allows vertical movements of the positioning portion.

A spring-biased operative plate is pivotably mounted to the adjusting base and has an operative end. An engaging plate is securely mounted above the operative plate and includes a positioning slot defined therein. The positioning slot includes a first end and a second end wherein the second end includes a positioning notch defined therein.

A spring means is mounted below the adjusting base, thereby allowing relative rocking motion between the mounting frame and the adjusting base. A spring-biased first adjusting rod is mounted below the engaging plate. The first adjusting rod has a first manually operable end and a second end having an operative surface which bears against the operative end of the operative plate. A pin extends through the positioning slot and is securely attached to the first adjusting rod to move therewith. A second adjusting rod is mounted to the adjusting base and bears against a pressure rod for adjusting a height of the chair seat.

When the pin is in the first end of the positioning slot, the second end of the first adjusting rod engages with the operative end of the operative plate while the mounting frame is rockable relative to the adjusting base. When the pin is retained in the positioning notch, the operative end of the operative plate is fittingly received in one of the engaging notches of the positioning portion while the mounting frame is not rockable relative to the adjusting base.

The adjusting base may include a hollow receiving section adjacent to the recess thereof. The hollow receiving section includes aligned first and second openings which are respectively defined in a first end and a second end thereof and through which the extension plate extends. The positioning portion on the distal end of the extension plate extends beyond the second opening which provides a space for the positioning portion to move vertically therein.

Preferably, the operative plate is biased by a torsion spring mounted on the adjusting base. At least one plate is mounted on the adjusting base. The plate is preferably mounted to a bottom of the operative plate and a bottom of the first adjusting rod. The plate has a height approximately the same as that of the torsion spring, thereby providing a smooth movements for the operative plate and the first adjusting rod.

Other objects, advantages, and novel features of the invention will become more apparent from the following detailed description when taken in conjunction with the accompanying drawings.

DESCRIPTION OF THE PREFERRED EMBODIMENT

Figure 1:
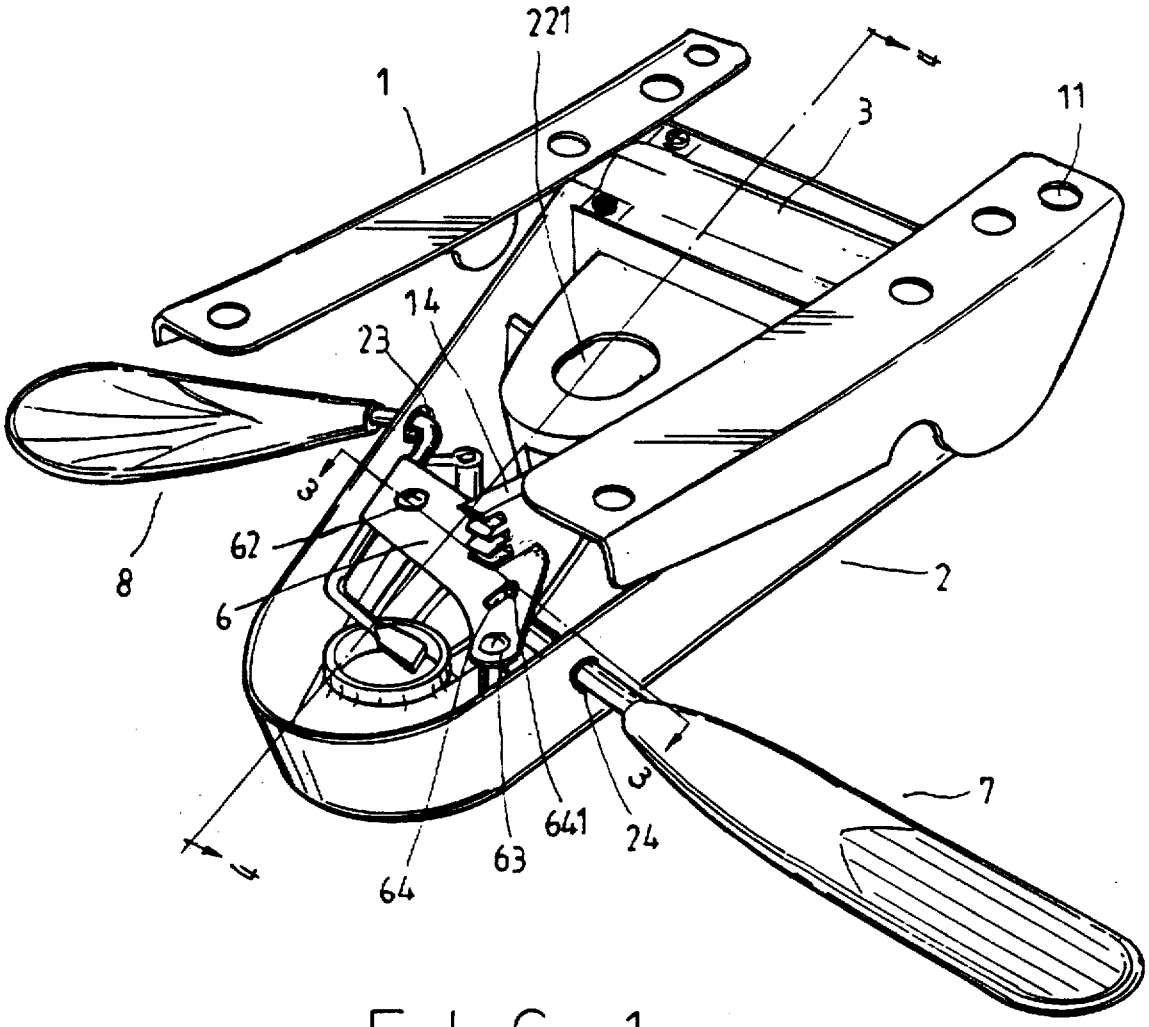
FIG. 1 is a perspective view of a positioning device in accordance with the present invention for a rocking type chair.
Figure 2:
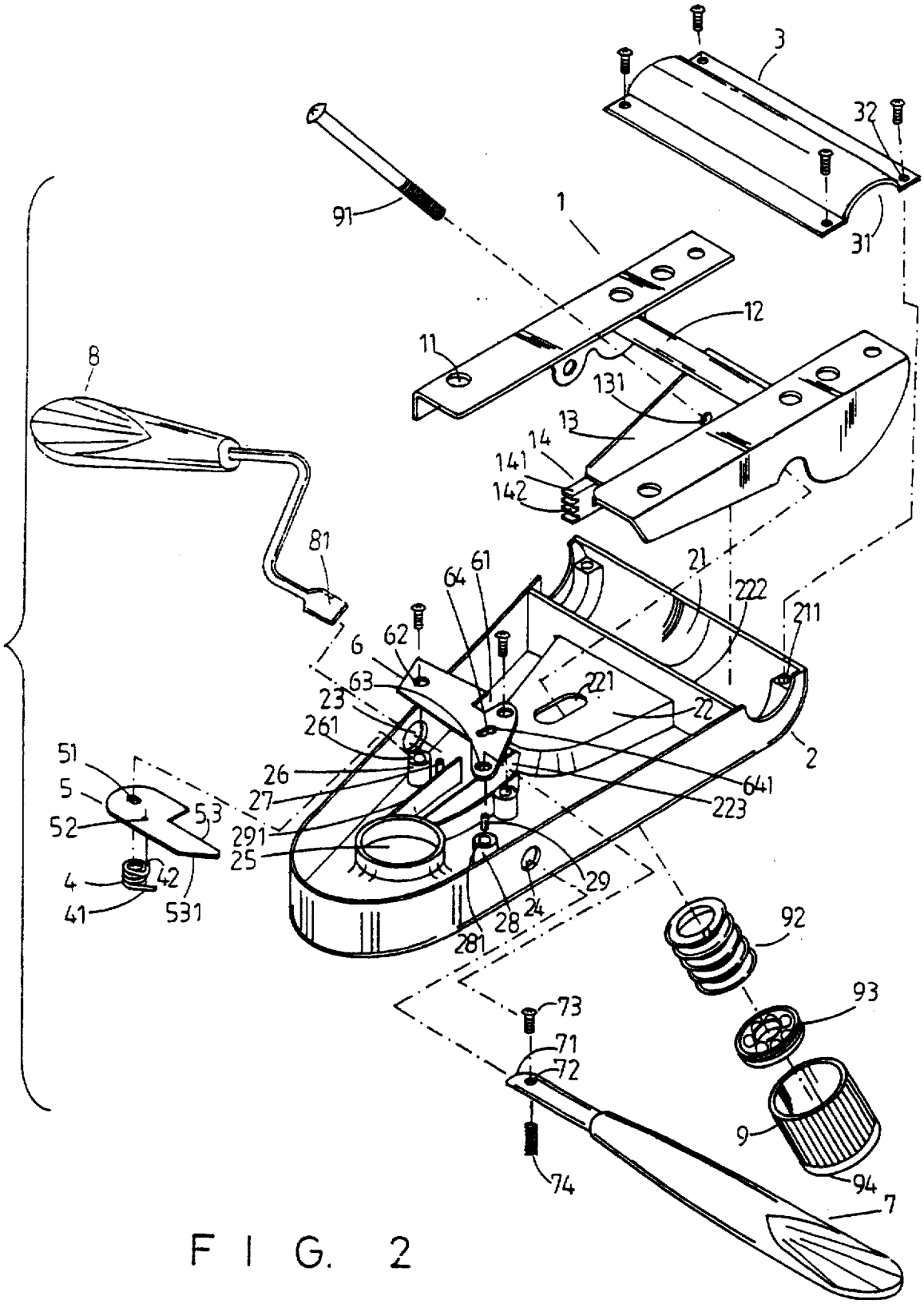
FIG 2 is an exploded view of the positioning device in accordance with the present invention.

Referring to FIGS. 1 to 8, and initially to FIGS. 1 and 2, a positioning device in accordance with the present invention for a rocking type chair generally includes a mounting frame 1, an adjusting base 2, an assembling plate 3, a torsion spring 4, an operative plate .5, an engaging plate 6, a first adjusting rod 7, a second adjusting rod 8, and a spring seat 9.

The mounting frame 1 includes a plurality of holes 11 through which fasteners (such as screws) may extend so as to securely attach the mounting frame 1 to an underside of a chair seat. The mounting frame 1 includes a connecting beam 12 at one end thereof and an extension plate 13 extending from the connecting beam 12. A bore 131 is defined in a mediate portion of the extension plate 13 through which an screw 91 extends, which will described in detail later. The extension plate 13 further includes a positioning portion 14 at a distal end thereof. The positioning portion 14 includes a plurality of vertically spaced engaging pieces 141 which are each equi-spaced by a respective one of a series of engaging notches 142 which each have a width slightly greater than that of the operative plate 5.

The adjusting base 2 includes a recess 21 defined in a first (rear) end thereof for pivotally receiving the connecting beam 12 of the mounting frame 1. The assembling plate 3 is mounted to cover the connecting rod 12 by screws (not labeled) extending through holes 32 defined in the assembling plate 3 and screw holes 211 defined in stubs (not labeled) provided in the recess 21. Preferably, the assembling plate 3 includes a receiving groove 31 defined in an underside thereof for partially receiving the connecting beam 12 such that the mounting frame 1 may rock inside the adjusting base 2.

The adjusting base 2 further includes a hollow receiving section 22 adjacent to the recess 21. The hollow receiving section 22 includes a through hole 221 defined in an upper side thereof and in alignment with the bore 131 of the extension plate 13. The hollow receiving section 22 further includes aligned first and second openings 222 and 223 which are respectively defined in a first end and a second end thereof and through which the extension plate 13 extends. In addition, the positioning portion 14 on the distal end of the extension plate 13 extends beyond the second opening 223 which provides a space for the positioning portion 14 to move vertically therein.

The adjusting base 2 further includes two through holes 23 and 24 respectively defined in two lateral walls thereof, wherein the second adjusting rod 8 may be extended through the through hole 23, while the first adjusting rod 7 may be extended through the through hole 24. A vertical bore 25 is defined in a second (front) end of the adjusting base 2 through which a pressure rod 100 (see FIG. 4) extends.

Figure 3:
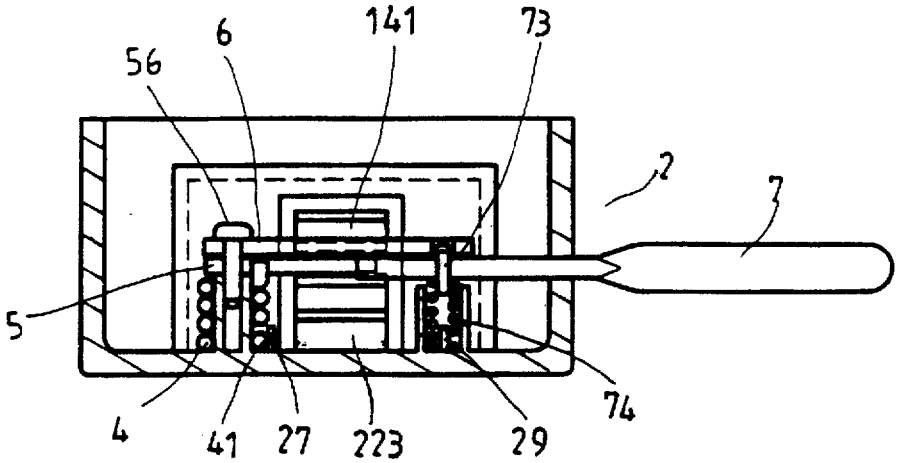
FIG. 3 is a cross-sectional view taken along line 3—3 in FIG. 1.

A first stub 26 is provided to an upper side of the adjusting base 2 for mounting the torsion spring 4 therearound, and the operative plate 5 is mounted on top of the first stub 26, which will be further described later. A post 27 is mounted to the upper side of the adjusting base 2 such that a first end 41 of the torsion spring 4 may bear against the post 27, thereby forming a point of application. Also mounted on the upper side of the adjusting base 2 is a second stub 28 which has a screw hole 281 defined therein for mounting the engaging plate 6. As shown in FIG. 3, a screw 56 is extended through a screw hole 62 in the engaging plate 6 and a hole 51 (see FIG. 2) defined in the operative plate 5 and then received in a screw hole 261 (FIG. 2) defined in the first stub 26, thereby allowing pivotal movement of the operative plate 5. It is appreciated that a diameter of the hole 51 may be slightly greater than an outer diameter of the first stub 26. The second stub 28 may limit a motion of the first adjusting rod 7, which will be described later. A second post 29 is provided adjacent to the second stub 28 and includes a diameter smaller than an inner diameter of a spring 74 so as to mount a lower end of the spring 74 around the second post 29. In addition a plate 291 is also mounted on the upper side of the adjusting base 2 adjacent to the first stub 26. The plate 291 has a height which is approximately the same as that of the torsion spring 4 such that the plate 291 may bear against a bottom of the operative plate 5 and a bottom of the first adjusting rod 7, thereby providing more stable motions for the operative plate 5 and the first adjusting rod 7.

The torsion spring 4 is mounted around the first stub 26 and may have a length slightly less than that of the first stub 26. In addition, the torsion spring 4 has the first end 41 which bears against the post and a second end 42 which is received in a hole 52 (see FIG. 2) defined in the operative plate 5 to bias the operative plate 5. The operative plate 5 further includes an operative end 53 which has an operative surface 531 for cooperating with an operative surface 71 of the first adjusting rod 7.

The engaging plate 6 includes a notch 61 defined in a first end thereof, the notch 61 having a width slightly greater than that of the positioning portion 14. The engaging plate 6 further includes holes 62 and 63 defined therein through which bolts (not labeled) may be extended to fasten the engaging plate 6 to the adjusting base 2 in a position above the operative plate 5. In addition, the engaging plate 6 includes a positioning slot 64 defined in a mediate portion thereof, the positioning slot 64 having a width slightly greater than the diameter of a pin 73, which will be described later. A periphery which defines the positioning hole 64 further includes a positioning notch 641 defined therein for positioning the pin 73, thereby positioning the first adjusting rod 7.

Figure 4:
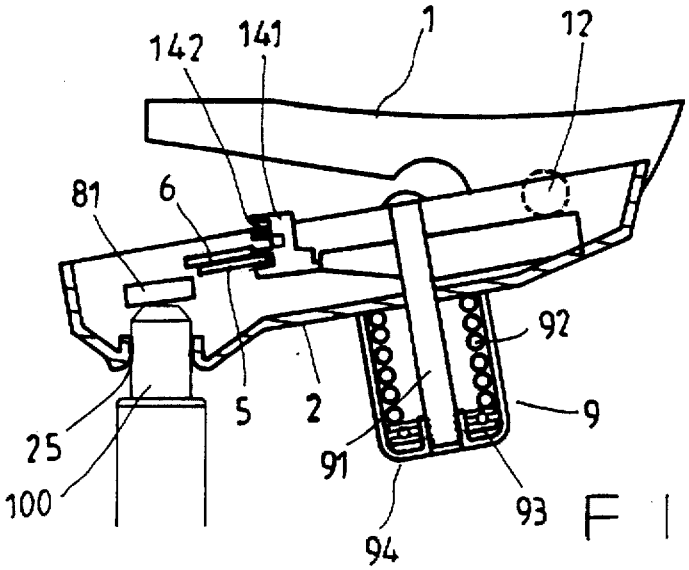
FIG. 4 is a cross-sectional view taken along line 4—4 in FIG. 1.

The operative surface 71 of the first adjusting rod 7 includes a hole 72 defined therein, and the pin 73 is extended through the hole 72 (see FIG. 3), while a spring 74 is mounted around the pin 73 and has an upper end projecting slightly beyond the hole 72. The second adjusting rod 8 includes a pressing end 81 which may press against a pressure rod 100 of the chair seat (see FIG. 4). As best shown in FIGS. 1, 2 and 4, the pressing rod 81 of the second adjusting rod 8 protrudes through the opening 23 in the side wall of the adjusting base 2 and is located above the vertical bore 25 of the adjusting base 2 which provides space for installation of the pressure rod 100 of the chair, such that the pressing end 81 bears against an end of the pressure rod 100. When the second adjusting rod 8 is pressed, the pressing end 81 exerts a force on the pressure rod 100 and thus allows the adjustment of vertical position of the pressure rod 100 as well as adjustment of the height of the chair. When the second adjusting rod 8 is released, the pressing end 81 no longer exerts the force onto the end of the pressure rod 100.

The height of the pressure rod 100, and accordingly the height of the chair, are thereby adjusted. The spring seat 9 includes the screw 91 which has an upper end extending through the through hole 221 of the adjusting base 2, a spring 92 mounted partially around the screw 91, a bearing 93 mounted to a lower end of the screw 91, and a cap 94. As can be seen in FIG. 4, the spring 92, the bearing 93, and the cap 94 are mounted below the extension plate 3 such that the frame 1 may rock relative to the adjusting base 2 due to the elasticity of the spring 92.

In assembly, referring to FIGS. 1 to 4, the extension plate 13 is inserted through the receiving section 22, while the connecting beam 12 is received in the recess 21. The assembling plate 3 is then applied to secure the frame 1 and the adjusting base 2 together, yet allowing relative rocking motions therebetween. The torsion spring 4 is mounted around the first stub 26 wherein the first end 41 thereof bears against the first post 27 and a second end 42 thereof is attached into the hole 52 of the operative plate 5. The spring 74 has a lower end attached to the second post 29 and the upper end thereof is attached to the first operative rod 7. Thereafter, screws 56 are applied to fasten the engaging plate 6 to the first and second stubs 26 and 28, while the pin 73 is in the positioning slot 64.

Figure 5:
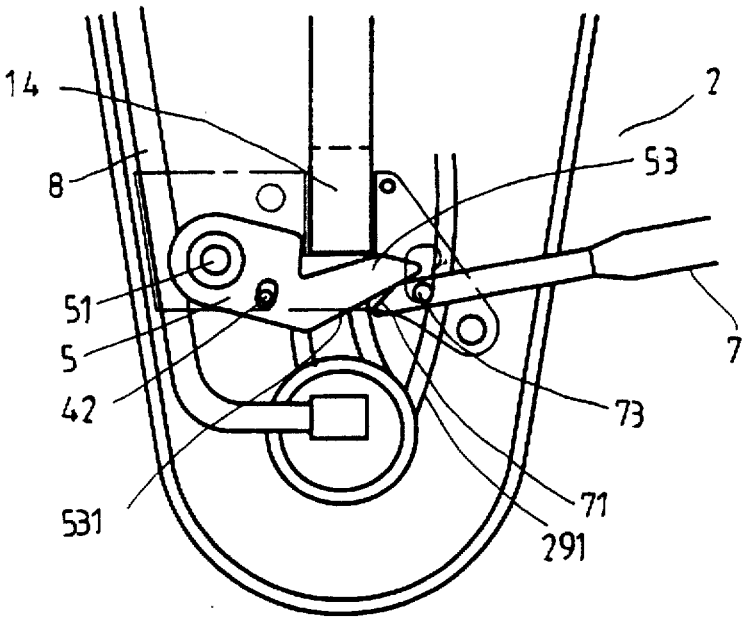

Referring to FIGS. 5 to 8, in operation, when the user intends to make the chair seat rock, the pin 73 is positioned in a front end of the positioning slot 64, as shown in FIG. 5. The operative end 53 of the operative plate 5, under the action of the torsion spring 4, is in front of the positioning portion 14 such that the user may change his/her center of gravity to make the extension plate 13 of the frame 1 rock inside the second opening 223 (see FIG. 8), while a distal end of the first adjusting rod 7 bears against the second post 28, thereby preventing disengagement between the first adjusting rod 7 and the operative rod 5.

Figure 6:
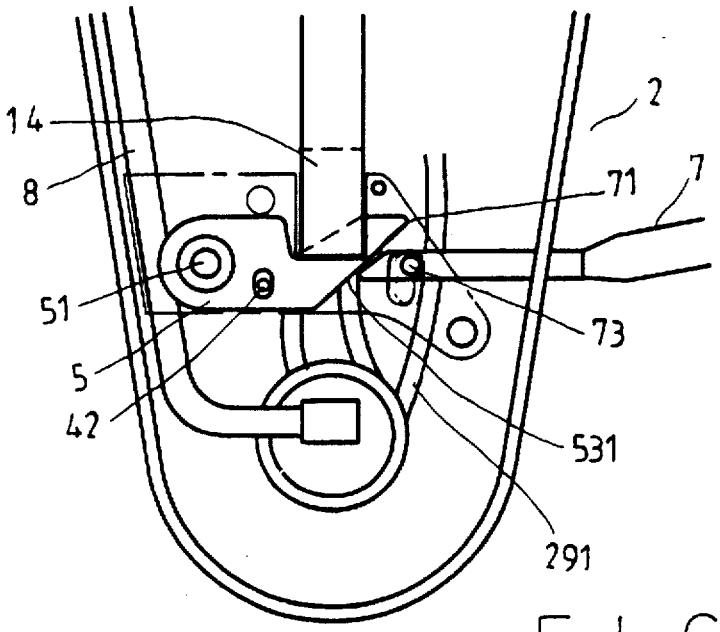
FIGS. 5 and 6 are schematic top plan views illustrating operation of the positioning device in accordance with the present invention, wherein an engaging plate thereof is illustrated in dotted lines for clarity.
Figure 7:
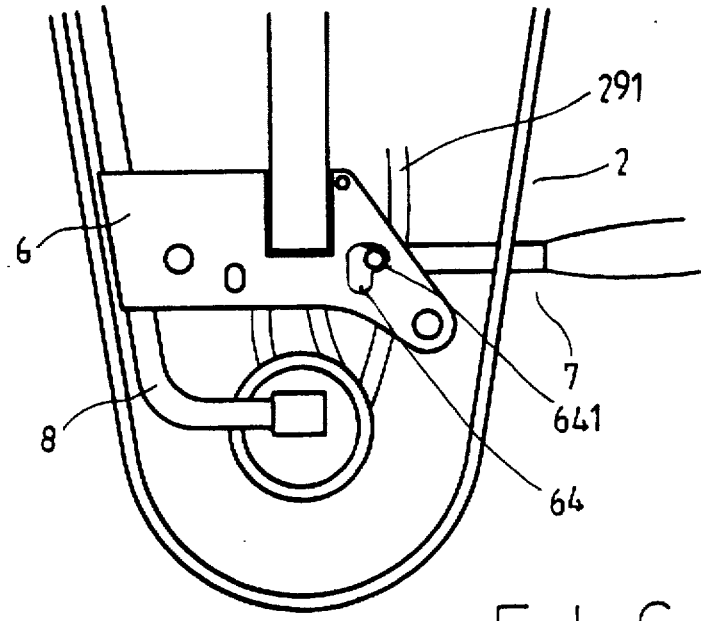
FIG. 7 is a schematic top plan view corresponding to FIG. 6, wherein the engaging plate is shown by solid lines.
Figure 8:
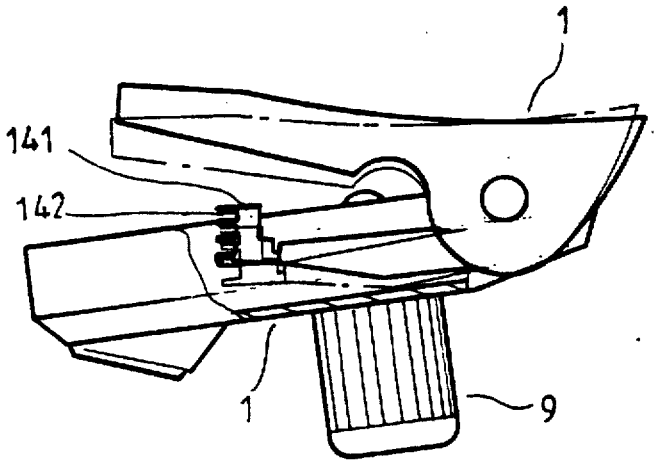
FIG. 8 is a schematic side elevational view illustrating rocking motion of the positioning device in accordance with the present invention.
Figure 9:
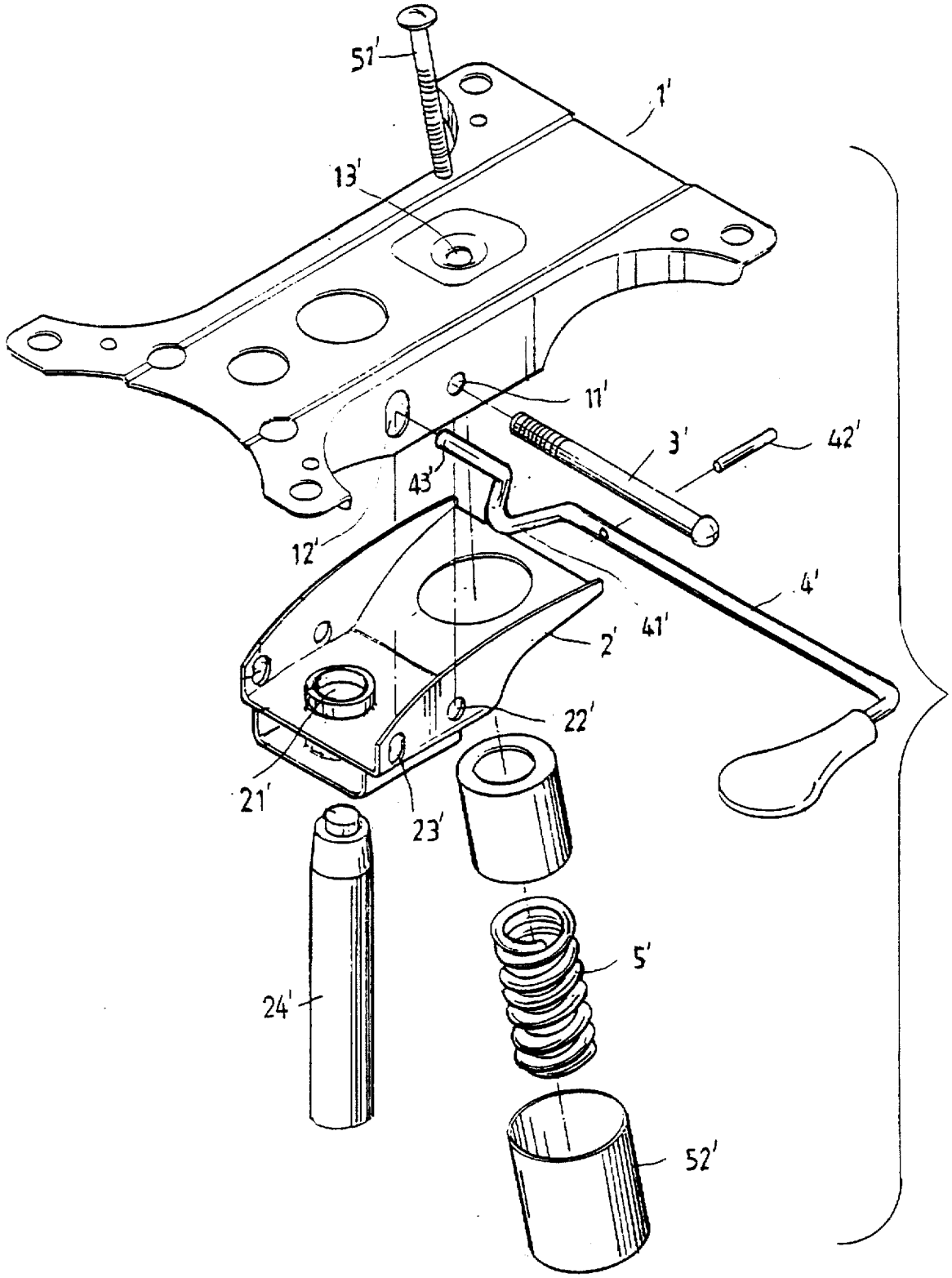
FIG. 9 PRIOR ART
FIG. 9 is an exploded perspective view illustrating a rocking type chair seat chassis structure according to prior art.

Referring to FIG. 6, when the user wishes to fix an inclination angle of the chair seat which is optimal for him/her, he/she may adjust his/her body to the most comfortable position in the chair seat which also changes the inclination angle of the chair seat to the preferred one, thereby adjusting the height of the positioning portion 14 of the frame 1. The first adjusting rod 7 is then manually moved until the pin 73 is retained in the positioning notch 641 (see FIG. 2). Since the operative face 531 of the operative plate 5 is borne against by the operative surface 71 of the first adjusting rod 7, the operative plate 5 is moved to a position where the operative end 53 of the operative plate 5 is fittingly received in an associated engaging notch 142, as shown in FIG. 7. Thus, the pin 73 is retained in the positioning notch 641 due to elasticity of the spring 74, thereby preventing disengagement between the operative end 53 of the operative plate 5 and the associated engaging notch 142.

According to the above description, the chair seat in accordance with the present invention may rock, while the user may fix the chair seat to a desired inclination angle, thereby providing comfort and safety while sitting. In addition, the rocking motion is limited by the height of the second opening 223 such that the user shall not fall due to a lack of balance resulting from over-rearward inclination of the chair seat.

Although the invention has been explained in relation to its preferred embodiment, it is to be understood that many other possible modifications and variations can be made without departing from the spirit and scope of the invention as hereinafter claimed.

What is claimed is:

1. A positioning device for a rocking type chair having a chair seat, the positioning device comprising:

a mounting frame adapted to be mounted to an underside of the chair seat, the mounting frame including a connecting beam at one end thereof, an extension plate extending from the connecting beam and having a positioning portion formed on a distal end thereof, the positioning portion including a plurality of vertically spaced engaging notches;

an adjusting base comprising a recess for pivotally receiving the connecting beam therein, the extension plate extending through the adjusting base while allowing vertical movements of the positioning portion thereof, the adjusting base including a hollow receiving section adjacent to the recess thereof, the hollow receiving section includes aligned first and second openings which are respectively defined in a first end and a second end thereof and through which the extension plate extends, the positioning portion on the distal end of the extension place extends beyond the second opening which provides a space for the positioning portion to move vertically therein;

a spring-biased operative plate pivotably mounted to the adjusting base, the operative plate having an operative end:

an engaging plate securely mounted above the operative plate and including a positioning slot defined therein, the positioning slot including a first end and a second end wherein the second end includes a positioning notch defined therein;

a spring means mounted below the adjusting base, thereby allowing relative rocking motion between the mounting frame and the adjusting base;

a spring-biased first adjusting rod mounted below the engaging plate, the first adjusting rod having a first manually operable end and a second end having an operative surface which bears against the operative end of the operative plate, a pin extending through the positioning slot and being securely attached to the first adjusting rod to move therewith; and a second adjusting rod mounted to the adjusting base and adapted to bear against a pressure rod for adjusting a height of the chair seat;

wherein when the pin is in the first end of the positioning slot, the second end of the first adjusting rod engages with the operative end of the operative plate while the mounting frame is rockable relative to the adjusting base, and when the pin is retained in the positioning notch, the operative end of the operative plate is fittingly received in one of the engaging notches of the positioning portion while the mounting frame is not rockable relative to the adjusting base.

2. The positioning device according to claim 1 wherein the operative plate is biased by a torsion spring mounted on the adjusting base.

3. The positioning device according to claim 2, further comprising at least one plate mounted on the adjusting base, said plate being mounted to a bottom of the operative plate and a bottom of the first adjusting rod, said plate having a height approximately the same as that of the torsion spring, thereby providing a smooth movements for the operative plate and the first adjusting rod.

* * * * *